United States Patent [19]

Strada

[11] Patent Number: 5,029,715

[45] Date of Patent: Jul. 9, 1991

[54] MODULAR MULTI-CONFIGURABLE DISPLAY SYSTEM FOR RETAIL MERCHANDISE

[75] Inventor: Robert V. Strada, Amagansett, N.Y.

[73] Assignee: Strada Design Associates, Inc., New York, N.Y.

[21] Appl. No.: 391,157

[22] Filed: Aug. 9, 1989

[51] Int. Cl.[5] ..... A47F 7/00

[52] U.S. Cl. ..... 211/55; 211/128

[58] Field of Search ..... 211/55, 128, 45, 46, 211/187

[56] References Cited

U.S. PATENT DOCUMENTS

| | | | |
|---|---|---|---|
| 1,835,744 | 12/1931 | Austin | 211/46 |
| 3,185,309 | 5/1965 | Radek | 211/46 |
| 3,297,374 | 1/1967 | Radek | 211/187 X |
| 3,685,687 | 8/1972 | Eckdahl | 211/128 X |
| 3,732,633 | 5/1973 | Margolis et al. | 211/46 X |
| 3,965,583 | 6/1976 | Price | 211/45 X |
| 4,119,207 | 10/1978 | Fuller et al. | 211/45 |
| 4,197,950 | 4/1980 | Ovitz, III | 211/187 X |
| 4,231,301 | 11/1980 | Barrineau, III | 211/187 X |
| 4,331,245 | 5/1982 | Schell | 211/45 X |
| 4,604,061 | 8/1986 | Willcocks et al. | 211/45 X |
| 4,762,235 | 8/1988 | Howard et al. | 211/187 X |

*Primary Examiner*—Carl D. Friedman
*Assistant Examiner*—Sarah Lechok
*Attorney, Agent, or Firm*—Kirschstein, Ottinger, Israel & Schiffmiller

[57] ABSTRACT

A modular multi-configurable system for displaying sheet-like flooring materials includes a number of discrete floor-supported uprights selectively arranged and interconnected in an arrangement conforming to a retail floor layout of any given design. The flooring materials are mounted in support trays mounted in channeled side panels secured to the uprights. Base and header panels complete the display.

19 Claims, 4 Drawing Sheets

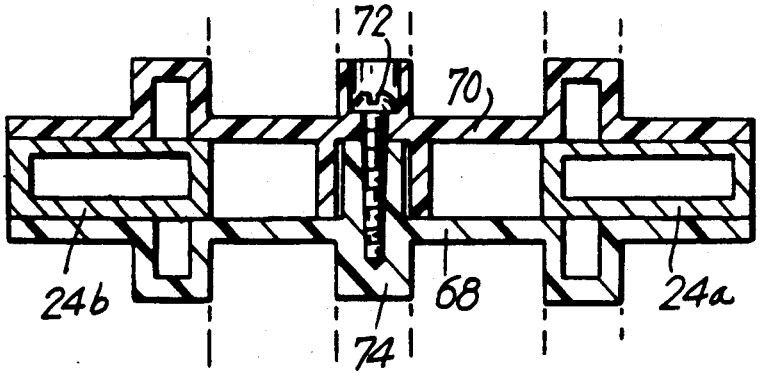
FIG. 7
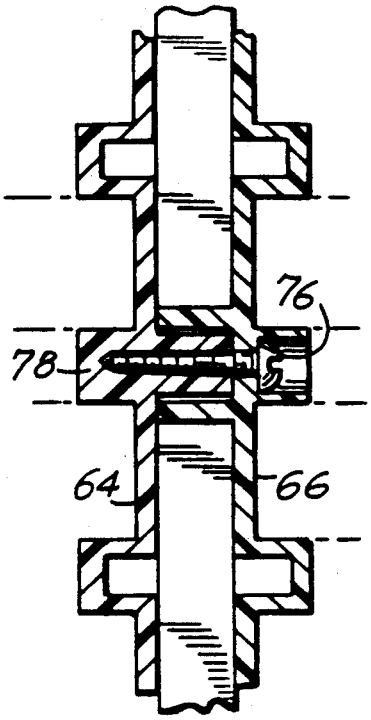
FIG. 8
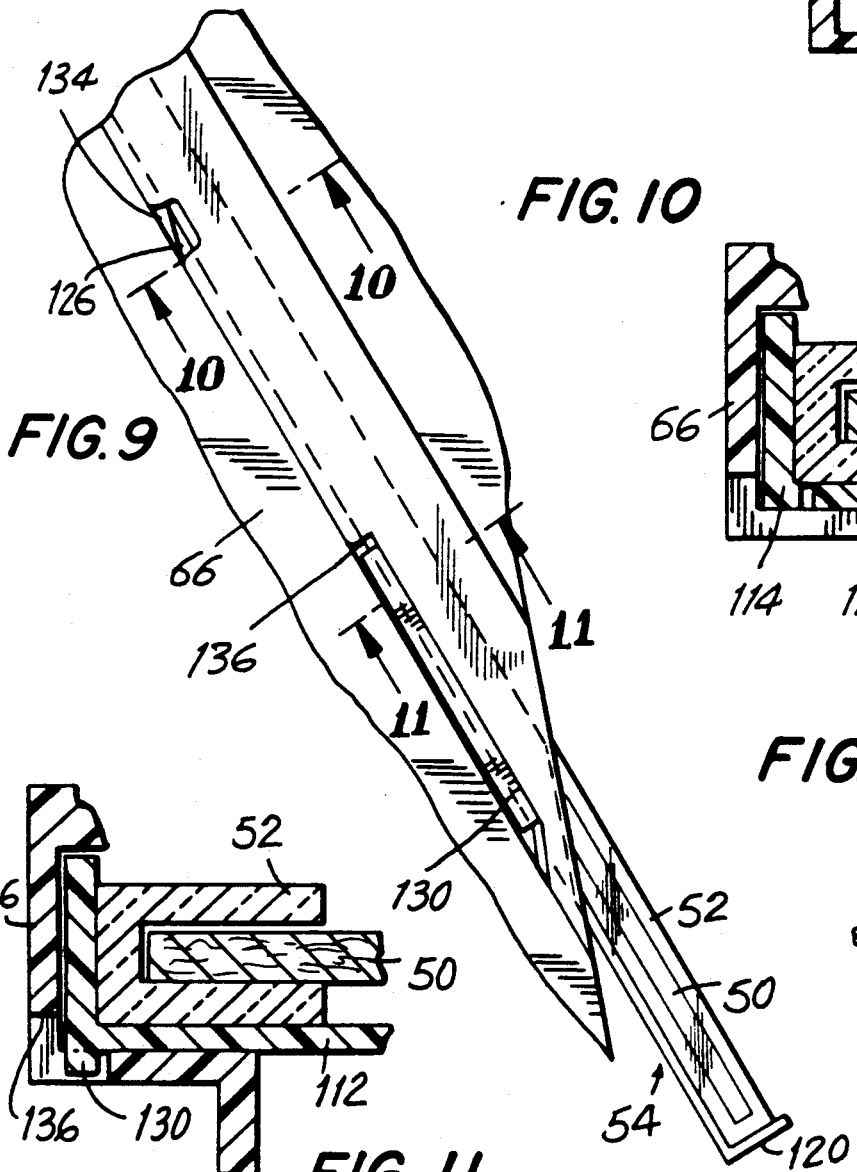
FIG. 9
FIG. 10
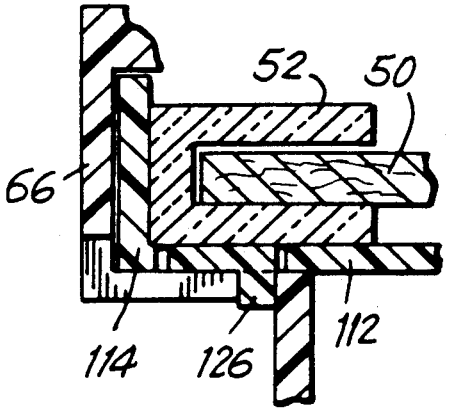
FIG. 12
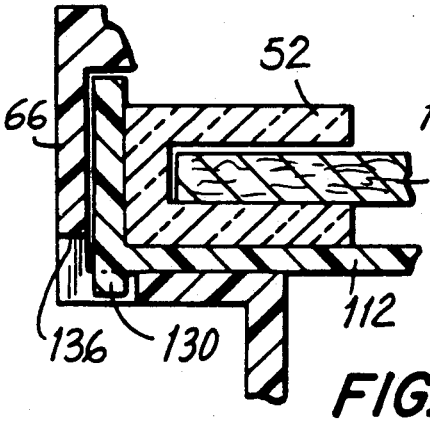
FIG. 11
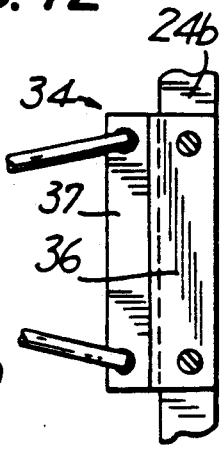

MODULAR MULTI-CONFIGURABLE DISPLAY SYSTEM FOR RETAIL MERCHANDISE

BACKGROUND OF THE INVENTION

1. Field of the Invention

This invention generally relates to a floormounted system for displaying retail merchandise, especially sheet-like flooring materials and, more particularly, to such a display system that can be arranged in any desired configuration that conforms to a retail floor layout of virtually any given design.

2. Description of Related Art

Sheet-like flooring materials, such as linoleum, tile and carpeting, are merchandised in a host of patterns and colors, and are typically displayed in retail stores in built-in permanent installations. Such installations are custom made for each retail floor layout. Depending on the size, number and location of outside and inside wall corners, as well as obstructions such as heating and cooling equipment, such custom-made installations can involve a considerable amount of carpentry and expense.

Due to their permanent nature, the known built-in installations represent substantial hindrances when a retailer wishes, for example, to move or alter existing displays. Rapidly and easily changing a floor layout to suit changing merchandising requirements is thus both physically and economically restrained.

SUMMARY OF THE INVENTION

1. Objects of the Invention

It is a general object of this invention to provide an attractive modular display system capable of being arranged into conformance with a given retail floor layout.

It is another object of this invention to easily and rapidly assemble, disassemble and reassemble a display system for retail merchandise.

A further object of this invention is to render a display system, particularly for flooring materials, more flexible and versatile than existing installations in order to meet changing merchandising requirements.

Yet another object of this invention is to erect a display system in a retail store without requiring extensive carpentry and expense.

Still another object of this invention is to provide a rugged, durable display system for flooring materials which meets a retailer's need to change the configuration of the display system as circumstances warrant.

2. Features of the Invention

In keeping with these objects, and others which will become apparent hereinafter, one feature of this invention resides, briefly stated, in a modular multi-configurable system for displaying retail merchandise, especially sheet-like flooring materials such as linoleum, tile, carpeting, etc.

The system comprises a plurality of discrete floor-supported uprights, and means for interconnectably and selectively arranging the uprights in an arrangement conforming to a retail floor layout. At least some of the uprights are arranged along a row. Each upright has an upper portion, a lower portion and opposite sides.

At least one base panel extends between, and is connected to, lower portions of uprights in the row. Preferably, a plurality of such base panels are provided, each extending between, and interconnected to, lower portions of adjacent uprights in the row. At least one header panel extends between, and is connected to, upper portions of uprights in the row. Preferably, a plurality of such header panels are provided, each extending between, and interconnected to, upper portions of adjacent uprights in the row.

The system further comprises a plurality of side panels mounted on the sides of the uprights. Each side panel has a plurality of slide channels. The slide channels on one side panel mounted on one of the uprights face, and are aligned with, the slide channels on another side panel mounted on another upright adjacent said one upright in the row. A plurality of support trays are also provided for supporting the retail merchandise. Each support tray is slidably mounted in the respective aligned slide channels.

The side panels are preferably arranged in pairs, with one side panel of each pair located at one side of a respective upright, while the other side panel of each pair is located at the other side of the respective upright. Fasteners are provided for fastening each pair of side panels together with the respective upright therebetween.

The pairs of fastened side panels are stacked one above another along the respective upright. It is desirable that the stacked pairs of side panels have interfitting portions of complementary contour. For example, the interfitting portions may include resilient legs and recesses respectively provided at facing portions of the stacked pairs of side panels. The legs engage the facing recesses with a snap-type action. The interfitting portions may also include inclined shoulders and extensions also respectively provided at facing portions of the stacked pairs of side panels. The extensions rest on, and are supported by, the facing shoulders.

Each support tray is lockingly mounted on a respective slide channel. For that purpose, each tray is provided with a pair of resilient fingers, and each pair of aligned slide channels is formed with a pair of openings. Upon full insertion of a support tray into a respective pair of aligned slide channels, the resilient fingers lockingly engage said openings. During such insertion, each support tray is guided by a pair of guide ribs provided thereon. Each rib is guided by a guide groove provided in each slide channel.

The lower portion of each upright has a floor-engaging elongated base. Each upright extends upwardly of the base, and also extends generally rearwardly from one end of the base toward, but terminating short of, the opposite end of the base. Each slide channel is inclined relative to the floor, with a front end region thereof at a lower elevation as compared to its rear end region. The inclined slide channels are arranged one above another between adjacent uprights. The inclined slide channels serve to inclinedly position the support trays along the lengths of adjacent uprights. Each support tray has a holder for holding a respective sheet material thereon, and preventing the sheet material from falling from its inclined support tray under the influence of gravity.

In the case where the sheet materials are floor covering samples, it is desired to mount each sample in its own frame. The frame-mounted samples are thus presented to a consumer in one or more stacks, with the lowermost or forward end of each sample exposed so that the consumer can readily inspect the pattern and color.

In use, the consumer will typically remove one of the frame-mounted samples from its support tray. In accordance with another feature of this invention, a forward part of each tray is formed with a cutout in order to expose more of the sheet material supported in a tray immediately below that of the tray from which the sample has been removed.

As described herein, the floor-supported system is easily and rapidly assembled, disassembled and reassembled in order to meet the physical space requirements of a particular floor layout. The system can be wrapped around both inside and outside wall corners, as well as heating and cooling equipment, without expensive carpentry or expense. The display system is more versatile than existing built-in custom-made installations, and enables the retailer to rapidly change the store displays to meet changing merchandising requirements.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7 is a sectional view taken on line 7—7 of FIG. 3;

FIG. 8 is a broken-away sectional view taken on line 8—8 of FIG. 3;

FIG. 9 is a fragmentary side view of a portion of the system of FIG. 1;

FIG. 10 is a broken-away sectional view taken on line 10—10 of FIG. 9;

FIG. 11 is a broken-away sectional view taken on line 11—11 of FIG. 9; and FIG. 12 is a broken-away plan view taken on line 12—12 of FIG. 3.

DETAILED DESCRIPTION OF THE PREFERRED EMBODIMENT

Figure 1:
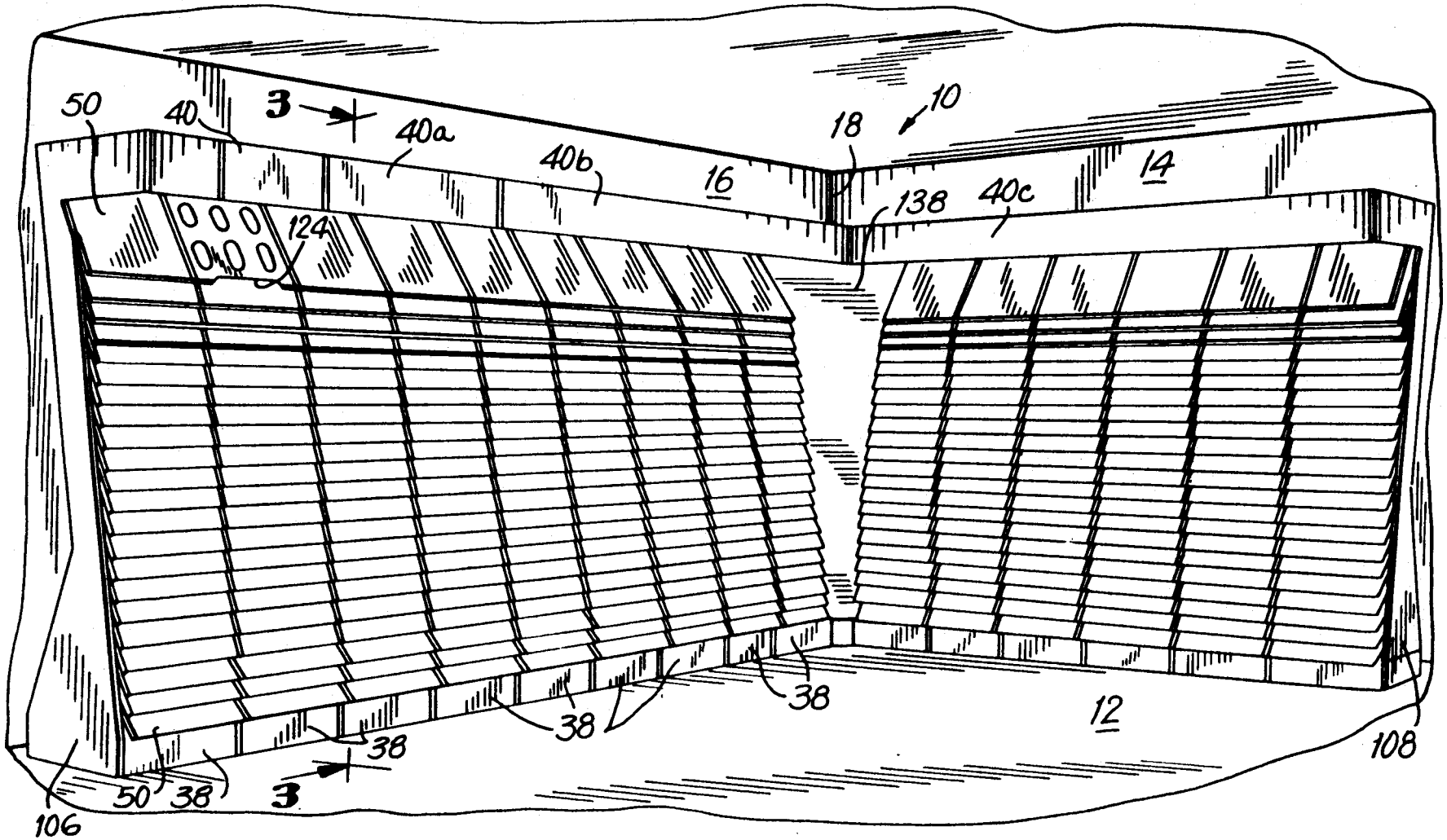
FIG. 1 is a front perspective view of a modular display system according to this invention.

Referring now to the drawings, reference numeral 10 generally identifies a modular multi-configurable display system for displaying retail merchandise, especially sheet-like flooring materials in stacks arranged in a layout of a retail store having a floor 12, and walls 14, 16 meeting at an inside corner 18. The system 10 can be assembled to conform to virtually any retail floor layout. For ease of description, the system is described and illustrated herein as being L-shaped in top plan view, and as extending along two linear rows running along walls 14 and 16 with the rows meeting at the corner 18.

Figure 2:
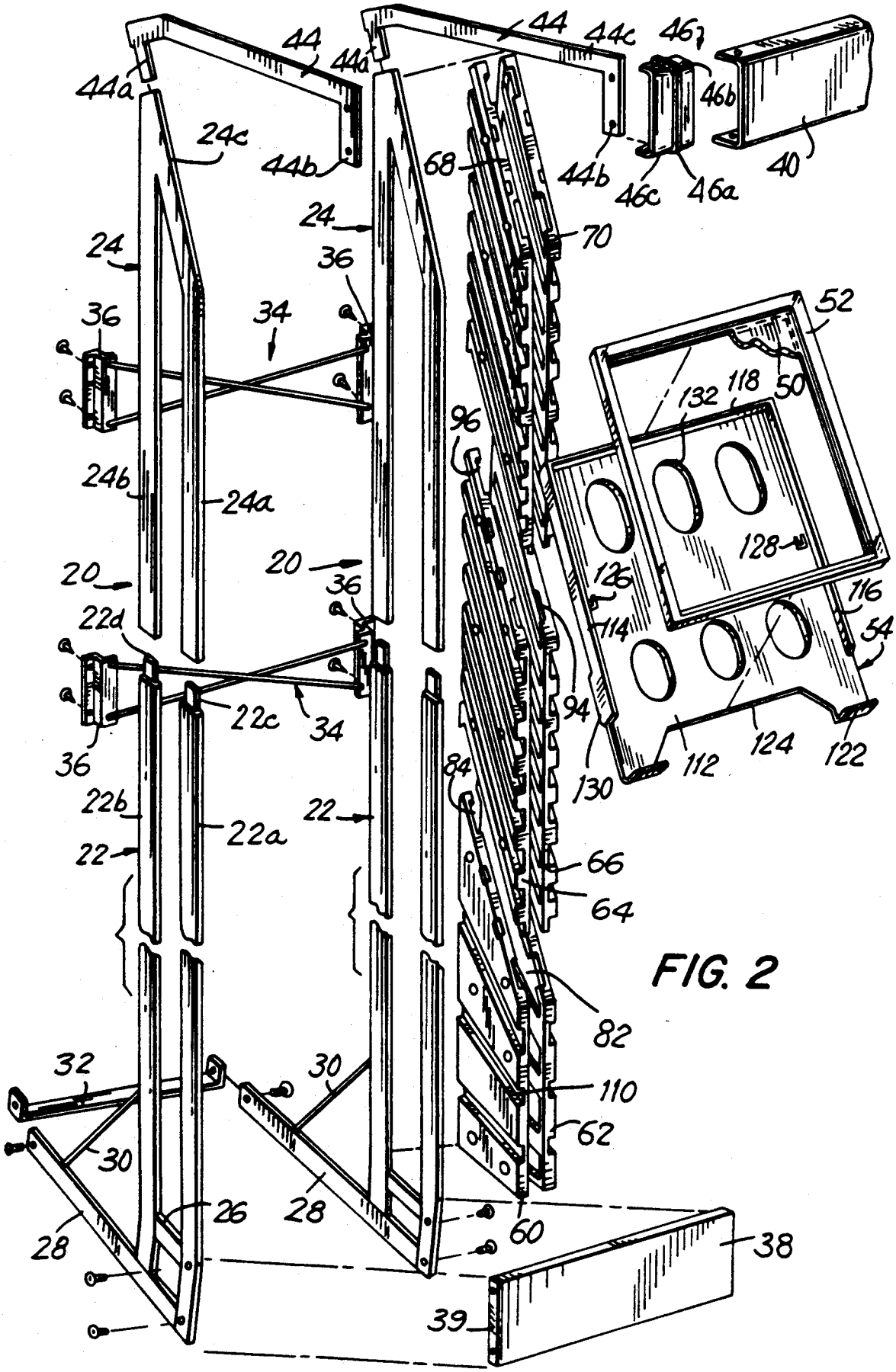
FIG. 2 is an exploded, enlarged, front perspective view of one of the modules of the display system of FIG. 1.

As best shown in FIG. 2, the system 10 includes a plurality of discrete, generally L-shaped uprights 20 arranged in a spaced-apart mutually-parallel relationship. Each upright 20 has a lower portion 22 consisting of twin tubular frame member **22*a*, 22*b* having respective upper fittings 22*c*, 22*d*, as well as an upper portion 24 consisting of twin tubular frame members 24*a*, 24*b* whose interiors respectively receive the fittings 22*c*, 22*d*** in a tight friction fit. Each frame member has a flattened, generally rectangular cross-section measuring about $\frac{1}{2}'' \times 1\frac{1}{2}''$ in the preferred embodiment, and being constituted of 16-gauge steel tubing.

The lower frame members **22*a*, 22*b* are interconnected by a horizontal cross-piece 26 and by a floorengaging base 28 which extends parallel to, and rearwardly beyond, the cross-piece 26. A rear inclined brace 30 extends between, and is connected to, a respective base 28 and rear lower frame member 22*b* to support the same. A rear cross-strap 32 extends between, and is connected to, a pair of adjacent bases 28** by fasteners, preferably threaded bolts.

The lower frame members **22*a*, 22*b* extend upwardly of the base 28 and, starting from the vicinity of the cross-piece 26, also extend generally rearwardly from the front end of the base 28 toward, but termating short of, the rear end of the base 28. The upper frame members 24*a*, 24*b* initially extend over most of their lengths along the inclinations of their respective lower frame members 22*a*, 22*b*. At its upper region, the upper frame member 24*a* changes from its mutually-parallel relationship with the upper frame member 24*b* and extends along a bent part 24*c* to intersect the upper frame member 24*b* at its highest point. The rear inclined brace 30 for each upright and the rear cross-strap 32** between adjacent uprights support the uprights and prevent them from tipping.

At least one rear cross-brace 34, and preferably two such cross-braces, each extend between and interconnect two adjacent uprights 20. Each cross-brace 34 includes a pair of metallic wires or rods arranged in an X-shaped pattern and welded together at the point of intersection, as well as a pair of mounting brackets 36 mounted on rear faces of the lower and upper frame members 22, 24. Each bracket 36 has a flange (see FIG. 12) directly mounted on a rear face of a respective frame member and connected thereto by a threaded fastener, and another flange 37 offset from the mounted flange and to which the rods are welded.

The system 10 further includes at least one base panel 38 having side flanges 39. Each base panel 38 extends between, and is connected at its flanges to, lower portions of the uprights 20. Preferably, a plurality of such base panels 38 are each connected between each two adjacent uprights. Each base panel 38 extends upwardly from a respective base 28 and has a height that corresponds to the elevation of the cross-pieces 26. As noted previously, it is from this point along the upright that the latter begins to incline rearwardly. The interconnection of the base panels to the uprights at the front of the display serves to reinforce and rigidify the front of the display, as well as providing an attractive finished look to the bottom of the display. Rather than providing one base panel between each two adjacent uprights, this invention also contemplates providing longer base panels, each of whose lengths spans more than two adjacent uprights to provide a less segmented, more continuous look for the overall display.

In analogous manner, the display system further includes at least one header panel 40 extending between, and connected to, upper portions of the uprights 20.

The header panel 40 is held at an overhead position forwardly of the base panel 38. The header panel typically contains some graphics indicative of the merchandise on display, for example, the name of the manufacturer of the flooring materials. The header panel is preferably constituted of a light-transmissive synthetic plastic material on which the graphics are imprinted, for example, by silk screening. The graphics are advantageously illuminated from behind by a light source 42 (see FIG. 3) mounted on, and suspended from, header arms 44.

Figure 4:
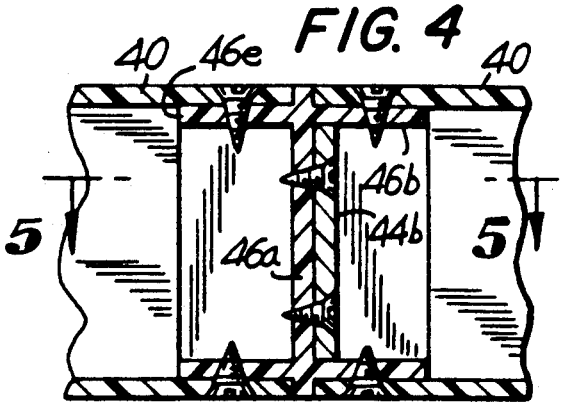
FIG. 4 is a broken-away sectional view taken on line 4—4 of FIG. 3.
Figure 5:
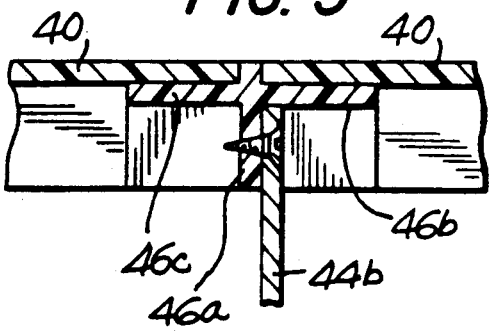
FIG. 5 is a broken-away sectional view taken on line 5—5 of FIG. 4.
Figure 6:
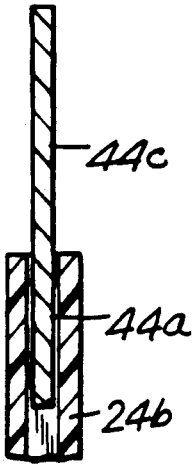
FIG. 6 is a broken-away sectional view taken on line 6—6 of FIG. 3.

Each header arm 44 has a rectangular insert portion 44*a* which is friction-tightly received in a rectangular opening within the upper frame member 24*b* (see FIG. 6). Each header arm 44 also has a mounting portion 44*b* on which a header bracker 46 is mounted, as well as an intermediate elongated portion 44*c* which extends generally forwardly from the insert portion 44*a* to the mounting portion 44*b*. As best shown in FIGS. 4 and 5, the bracket 46 has a central part 46*a* to which the mounting portion 44*b* is bolted by appropriate fasteners, and also has oppositely-directed channel-shaped end parts 46*b*, 46*c*. Each end part is slidably inserted in a correspondingly contoured channel-shaped header panel 40 and fastened thereto by appropriate fasteners.

Bracket 46 having two coplanar end parts, as shown in FIG. 2, is intended to interconnect two header panels in an end-to-end relationship and position them in a common plane. By eliminating one of the end parts, for example, end part 46*c*, the so-modified bracket can be used at the end of a row at which only one header panel is needed. By positioning the two end parts at right angles to each other, the so-modified bracket can be used to interconnect two header panels which are intended to be positioned perpendicularly to each other.

The length of the header panel can be selected to span just two adjacent uprights as in the preferred embodiment for the base panels 38, or can be made longer to span multiple uprights. FIG. 1 shows header panels 40, 40*a*, 40*b*, 40*c*, all of increasing lengths in the order named. The aforementioned light source 42 is preferably a fluorescent lamp fixture whose length corresponds to that of the header panel to be illuminated by the fluorescent lamp.

As best shown in FIGS. 2 and 5, different samples of the sheet-like flooring material are each identified by reference numeral 50. Each sample 50 is mounted in a rectangular support frame 52 to facilitate handling by a consumer. Each frame-supported sample 50 is removably mounted in a support tray 54 which, in turn, is supported and secured between adjacent uprights 20. As described below, the trays and samples are inclined relative to the floor, with front portions of the trays and samples at lower elevations than their corresponding rear portions. The inclined trays and samples are stacked one above another and in multiple stacks. The front portions of the trays and the samples extend forwardly beyond the plane of the base panel 38, and are viewable to the consumer for inspection purposes. Examples of such samples on display include linoleum, vinyl tile, ceramic tile, wood tile, carpet tile, and carpeting.

The stacks of inclined trays 54 are supported by multi-channeled side panels mounted on the sides of the uprights. Preferably, the side panels are arranged in pairs, with the two side panels of each pair fastened to each other and sandwiching the upright therebetween. As shown in FIG. 2, the side panels include a first or bottom pair of side panels 60, 62, a second or middle pair of side panels 64, 66 stacked vertically immediately above the bottom pair, and a third or upper pair of side panels 68, 70 stacked vertically immediately above the middle pair.

As shown in FIG. 7 for the upper pair 68, 70, these panels are fastened together by threaded fasteners 72 which self-tap into post 74. As shown in FIG. 8 for middle panel pair 64, 66, these side panels are fastened together by threaded fasteners 76 which self-tap into another post 78. Each pair of side panels is rigidly clamped on the upright sandwiched therebetween.

Figure 3:
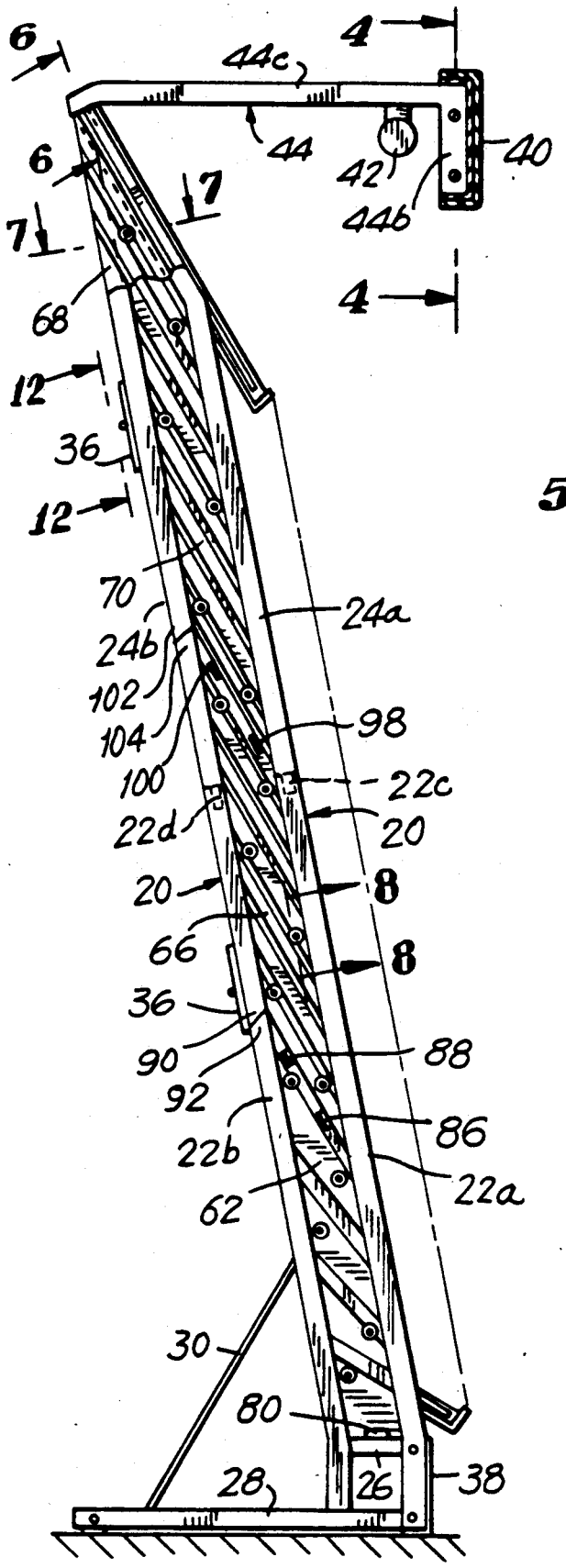
FIG. 3 is a sectional view taken on line 3—3 of FIG. 1.

As best shown in FIG. 3, the bottom pair of side panels has support flanges 80 adjacent their lower edge regions. The support flanges 80 rest on, and are supported by, the cross-piece 26. The bottom pair of side panels together form rectangular recesses 82, 84 (see FIG. 2) at their upper edge regions. Recesses 82, 84 receive with snap-type action L-shaped resilient legs 86, 88 extending downwardly from the lower edge regions of the middle pair of side panels.

The lower edge regions of the middle pair of side panels also have a rear inclined extension 90 which rests on and is supported by an inclined shoulder 92 on the upper edge portions of the bottom pair of side panels. This prevents front-to-back shifting of the stacked side panels.

In analogous manner, the middle pair of side panels together form rectangular recesses 94, 96 (see FIG. 2) at their upper edge regions. Recesses 94, 96 receive with snap-type action L-shaped resilient legs 98, 100 extending downwardly from the lower edge regions of the upper pair of side panels.

The lower edge regions of the upper pair of side panels also have a rear inclined extension 102 which rests on, and is supported by, an inclined shoulder 104 on the upper edge regions of the middle pair of side panels.

As described so far, the stacked and snappingly-interfitted side panels 60, 64, 68 are securely fastened to one side of an upright in a common plane, and the stacked and snappingly-interfitted side panels 62, 66, 70 are securely fastened to the opposite side of the upright in another common plane generally parallel to the first-mentioned plane. This arrangement is identical for all the uprights, except the last upright in each row where, for esthetic purposes, the outer side of each upright is not provided with multi-channeled side panels, but, instead, is provided with a generally planar, nonchanneled, smooth, outer finish panel 106 or 108 (see FIG. 1).

As previously mentioned, each side panel is multi-channeled, and is provided with a plurality of slide channels 110. The slide channels on one side panel mounted on one of the uprights face, and are respectively aligned with, the slide channels formed on another side panel mounted on another upright adjacent the first-mentioned upright. Each support tray 54 is slidably mounted in the respective aligned slide channels 110. Due to the fact that it is desired to present each sample 50 with the same amount of its front part showing and, furthermore, due to the fact that the upright is rearwardly inclined, the slopes of the slide channels increase as a function of increasing elevation relative to the floor. Thus, the slopes of the slide channels of the bottom pair of side panels are greater than the corresponding slopes of the slide channels formed in the side panels of either the middle or upper pair of side panels.

Preferably, each support tray 54 is lockingly received in the respective aligned slide channels. To that end, as best shown in FIGS. 2 and 9–11, each tray 54 has a bottom part 112, a pair of side parts 114, 116, a back part 118, and a pair of front holder parts 120, 122. A cutout 124 is formed in the front of each tray 54. A pair of resilient fingers 126, 128 are integrally formed with the bottom part 112. A pair of guide ribs 130 are integrally formed with the side parts 114, 116. Each support tray 54 is preferably made of a resilient synthetic plastic material and, for purposes of reducing the weight and cost of manufacture of each tray 54, a plurality of holes 132 are formed in the base part 112.

Each support tray is inserted along the slope of each respective pair of aligned slide channels. During such insertion, each resilient finger 126, 128, which is initially positioned out of the plane of the back part 112, is displaced. Upon full insertion, the resilient finger 126, 128 are self-returned back to their initial position where they overlie a pair of openings 134 formed toward the rear of each slide channel 110. Once each resilient finger is snappingly received in a corresponding opening 134, the support tray is locked in position. Each side panel is also provided with a pair of guide grooves 136 for guiding the guide ribs 130 of each support tray during such insertion.

Returning to FIG. 1, the uprights 20 are arranged in two linear rows meeting at a common corner 18. A smooth, non-channeled, outer finish panel 138 overlies the corner 18 to provide a finished appearance thereat for the display. The support trays and the samples supported thereon are available to the consumer for ready inspection in multiple stacks. The aforementioned cutout 124 is particularly advantageous for viewing more of the sample stored on a lower tray in the case where the sample on an upper tray has been removed.

Each pair of uprights, base panel 38, one or more rear braces 34, one or more header arms 44, a plurality of side panels and the trays 54 constitute a module which, together with other modules, constitutes the overall display system. It will be understood that only one upright is needed and is shared by two adjacent modules.

The system described herein is readily assembled, disassembled and reassembled in order to conform to any given retail floor layout. Individual modules can be moved, taken away or added in order to meet the retailer's changing merchandising requirements.

It will be understood that each of the elements described above, or two or more together, also may find a useful application in other types of constructions differing from the types described above.

While the invention has been illustrated and described as embodied in a modular multi-configurable display system for retail merchandise, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A modular, multi-configurable system for displaying retail merchandise, comprising:

(a) a plurality of discrete, floor-supported uprights, each having an upper portion, a lower portion and opposite lateral sides;

(b) means for interconnectably and selectively arranging the uprights, at least some of the uprights being arranged along a row;

(c) at least one base panel extending between, and connected to, the lower portions of the uprights in the row;

(d) at least one header panel extending between, and connected to, the upper portions of the uprights in the row;

(e) a plurality of side panels arranged in pairs, each said pair of said side panels being mounted on both said opposite lateral sides of each said upright;

(f) fastener means for fastening each said pair of said side panels together with a respective said upright therebetween;

(g) a plurality of slide channels on each said side panel, said slide channels on one of the side panels mounted on one of the uprights, and being aligned with and in facing relationship to the slide channels on another of the side panels mounted on another said upright adjacent said one upright in the row; and (h) a plurality of support trays for supporting the retail merchandise, each said support tray being slidably mounted in the respective said aligned slide channels between said side panels of said adjacent uprights.

2. The system according to claim 1, wherein the lower portion of each said upright has a floor-engaging, elongated base having opposite ends; and wherein each said upright extends upwardly of the base and also extends generally rearwardly from one end of the base toward, but terminates short of, the opposite end of the base.

3. The system according to claim 2, wherein the upper portions of at least two said uprights in the row each have an elongated header arm extending generally forwardly of, and elevated above, a respective said base.

4. The system according to claim 2, wherein each said upright includes a pair of elongated frame members, each extending between said lower and upper portions of a respective upright.

5. The system according to claim 4, wherein each said upright includes an inclined brace extending between, and connected to, a respective said base and one of the frame members.

6. The system according to claim 4, wherein each said frame member includes a pair of frame portions fitted on each other.

7. The system according to claim 1, wherein the arranging means includes a plurality of rear braces extending between, and interconnecting, the uprights.

8. The system according to claim 1, wherein said at least one header panel has a generally C-shaped interior; and further comprising header brackets mounted on said upper portions of said uprights in the row, each header bracket being insertable into the C-shaped interior of said at least one header panel and being connected thereto.

9. The system according to claim 1, wherein the system includes a plurality of said base panels, each extending between, and connected to, said lower portions of adjacent said uprights in the row.

10. The system according to claim 1, wherein a plurality of said pairs of said side panels are stacked, one above another, along the respective said upright.

11. The system according to claim 10, wherein the stacked pairs of said side panels have interfitting facing portions of complementary contour.

12. The system according to claim 1, wherein the retail merchandise includes a plurality of sheet materials, each removably mounted on a respective said support tray supported between adjacent said uprights.

13. The system according to claim 12, wherein each said slide channel has a front end region and a rear end region; and wherein each said slide channel is inclined relative to the floor, with the rear end region at a higher elevation than the corresponding front end region of a respective said slide channel; and wherein the inclined slide channels are arranged, one above another, between adjacent said uprights and inclinedly position the support trays along a stack.

14. The system according to claim 12, wherein the sheet materials are floor covering samples mounted in a frame.

15. A modular, multi-configurable system for displaying retail merchandise, comprising:

(a) a plurality of discrete, floor-supported uprights, each having an upper portion, a lower portion and opposite lateral sides;

(b) means for interconnectably and selectively arranging the uprights, at least some of the uprights being arranged along a row;

(c) at least one base panel extending between, and connected to, the lower portions of the uprights in the row;

(d) at least one header panel extending between, and connected to, the upper portions of the uprights in the row;

(e) a plurality of side panels mounted on the opposite lateral sides of the uprights, each said side panel having a plurality of slide channels, said slide channels on one of the side panels mounted on one of the uprights, and being aligned with and in facing relationship to, the slide channels on another of the side panels mounted on another said upright adjacent said one upright in the row, said side panels being arranged in pairs, one said side panel of each said pair being located at said one lateral side of a respective said upright, and the other side panel of each said pair being located at the other lateral side of the respective said upright, a plurality of said pairs of said side panels being stacked, one above another, along the respective said upright, said stacked pairs of said side panels having interfitting facing portions of complementary contour, said interfitting facing portions including resilient legs and facing recesses respectively provided at the stacked said pairs of said side panels, said resilient legs engaging the facing recesses with a snap-type action;

(f) fastener means for fastening each said pair of said side panels together with the respective said upright therebetween; and (g) a plurality of support trays for supporting the retail merchandise, each said support tray being slidably mounted in the respective said aligned slide channels.

16. A modular, multi-configurable system for displaying retail merchandise, comprising:

(a) a plurality of discrete, floor-supported uprights, each having an upper portion, a lower portion and opposite lateral sides;

(b) means for interconnectably and selectively arranging the uprights, at least some of the uprights being arranged along a row;

(c) at least one base panel extending between, and connected to, the lower portions of the uprights in the row;

(d) at least one header panel extending between, and connected to, the upper portions of the uprights in the row;

(e) a plurality of side panels mounted on the opposite lateral sides of the uprights, each said side panel having a plurality of slide channels, said slide channels on one of the side panels mounted on one of the uprights, and being aligned with, the slide channels on another of the side panels mounted on another said upright adjacent said one upright in the row, said side panels being arranged in pairs, one said side panel of each said pair being located at said one lateral side of a respective said upright, and the other side panel of each said pair being located at the other lateral side of the respective said upright, a plurality of said pairs of said side panels being stacked, one above another, along the respective said upright, said stacked pairs of said side panels having interfitting facing portions of complementary contour, said interfitting facing portions including extensions and inclined facing shoulders respectively provided at the stacked said pairs of said side panels, said extensions resting on the facing shoulders;

(f) fastener means for fastening each said pair of said side panels together with the respective said upright therebetween; and (g) a plurality of support trays for supporting the retail merchandise, each said support tray being slidably mounted in the respective said aligned slide channels.

17. A modular, multi-configurable system for displaying retail merchandise, comprising:

(a) a plurality of discrete, floor-supported uprights, each having an upper portion, a lower portion and opposite lateral sides;

(b) means for interconnectably and selectively arranging the uprights, at least some of the uprights being arranged along a row;

(c) at least one base panel extending between, and connected to, the lower portions of the uprights in the row;

(d) at least one header panel extending between, and connected to, the upper portions of the uprights in the row;

(e) a plurality of side panels mounted on the opposite lateral sides of the uprights, each said side panel having a plurality of slide channels, said slide channels on one of the side panels mounted on one of the uprights, and being aligned with and in facing relationship to, the slide channels on another of the side panels mounted on another said upright adjacent said one upright in the row; and (f) a plurality of support trays for supporting the retail merchandise, each said support tray being slidably mounted in the respective said aligned slide channels, each said support tray having a pair of resilient fingers located thereon, and each said pair of said aligned slide channels having a pair of openings for lockingly receiving a resilient said finger upon full insertion of a respective said support tray into a respective said pair of said aligned slide channels.

18. The system according to claim 18, wherein each said support tray has a pair of guide ribs, and wherein each said pair of said aligned slide channels has a pair of guide grooves for guidably receiving the respective said support tray during said insertion.

19. A modular, multi-configurable system for displaying a plurality of sheet materials, comprising:

(a) a plurality of discrete, floor-supported uprights, each having an upper portion, a lower portion and opposite lateral sides;

(b) means for interconnectably and selectively arranging the uprights, at least some of the uprights being arranged along a row;

(c) at least one base panel extending between, and connected to, the lower portions of the uprights in the row;

(d) at least one header panel extending between, and connected to, the upper portions of the uprights in the row;

(e) a plurality of side panels mounted on the opposite lateral sides of the uprights, each said side panel having a plurality of slide channels, said slide channels on one of the side panels mounted on one of the uprights, and being aligned with and in facing relationship to, the slide channels on another of the side panels mounted on another said upright adjacent said one upright in the row, each slide channel having a front end region and a rear end region, each said slide channel being inclined relative to the floor, with the rear end region at a higher elevation than the corresponding front end region of a respective slide channel;

(f) a plurality of support trays, each supporting a respective said sheet material between said adjacent uprights, each said support tray being slidably mounted in the respective said aligned slide channels, said inclined slide channels being arranged, one above another, between said adjacent uprights and inclinedly positioning the support trays along a stack, each said support tray having a front tray portion extending forwardly of a respective said slide channel, each said front tray portion having a cutout for viewing a respective said sheet material on a lower said tray below an upper said tray from which the respective sheet material has been removed; and (g) a holder for holding a respective said sheet material on a respective said support tray.

* * * * *